US005364148A

United States Patent [19]

Bartocci

[11] Patent Number: 5,364,148

[45] Date of Patent: Nov. 15, 1994

[54] CARRYING HANDLE

[76] Inventor: Anna Bartocci, 605 W. 113th St., Apartment 42, New York, N.Y. 10025

[21] Appl. No.: 5,292

[22] Filed: Jan. 19, 1993

[51] Int. Cl.[5] ..... A45C 13/26; B65D 33/06

[52] U.S. Cl. ..... 294/171; 294/137

[58] Field of Search ..... 294/137, 153, 165–167, 294/170, 171; 16/110 R, 114 R, 114 A, 114 B, 116 R; 229/117.09, 117.19; 383/6, 13, 17, 25, 26, 29

[56] References Cited

U.S. PATENT DOCUMENTS

| | | | |
|---|---|---|---|
| 499,481 | 6/1893 | Swegles | 294/171 |
| 776,805 | 12/1904 | Salzberg | 294/171 X |
| 1,008,604 | 11/1911 | Lake | 16/114 B X |
| 1,359,461 | 11/1920 | Luce | 294/171 X |
| 1,793,575 | 2/1931 | Williams | 294/171 X |
| 2,274,605 | 2/1942 | Hoffmeister | 294/171 X |
| 2,444,558 | 7/1948 | Elliott | 294/171 |
| 2,821,739 | 2/1958 | Mohs | 16/114 B |
| 3,243,020 | 3/1966 | Friedlander | 294/171 X |
| 4,262,385 | 4/1981 | Norman | 294/171 X |
| 5,083,825 | 1/1992 | Bystrom et al. | 294/171 |

FOREIGN PATENT DOCUMENTS

| | | | |
|---|---|---|---|
| 3347410 | 7/1985 | Germany | 294/171 |
| 3509679 | 9/1986 | Germany | 294/171 |

*Primary Examiner*—Johnny D. Cherry
*Attorney, Agent, or Firm*—Howard C. Miskin

[57] ABSTRACT

A supplemental grip device for use with flexible handles of shopping bags includes a tubular grip member formed of a soft resiliently compressible material and having a longitudinal slot in the top thereof and a stiff core member nesting in the grip member and having a longitudinal upper face confronting and located below the grip member slot. The grip and core member assembly may be enclosed in a flexible sheath or in an envelope whose closed upper border is tucked through the slot to the core face.

8 Claims, 2 Drawing Sheets

CARRYING HANDLE

BACKGROUND OF THE INVENTION

The present invention relates generally to improvements in receptacle handles and it relates particularly to an improved supplement device for the handles of shopping bags and the like.

The conventional shopping bag, whether of the reusable or disposable type, is generally provided with handles at the opposite top border thereof, such handles being highly flexible and being integrally formed with or attached at their opposite ends to the bag border. Each handle includes an upper flexible medial longitudinal portion terminating in legs attached to or integrally formed with the bag's upper border. The handles are either formed of flexible plastic or of cord and, when used, the longitudinal portions are brought together and gripped by the user.

The use of shopping bags of the above nature possesses many drawbacks and disadvantages. The are highly awkward and inconvenient to properly use and are at best very uncomfortable and wearing. Moreover, to keep the shopping bag closed, both handles must be grasped and held by the hand to retain the bag in a closed condition, the release of the handles resulting in the undesirable opening of the carried shopping bag. The conventional shopping bag thus leaves much to be desired.

SUMMARY OF THE INVENTION

A principal object of the present invention is to provide an improved handle attachment.

Another object of the present invention is to provide an improved supplemental device for receptacle handles.

Still another object of the present invention is to provide an improved supplemental device for application to the handles of the shopping bag.

A further object of the present invention is to provide an improved replaceable device for releasably engaging the opposing handles of a reusable or disposable shopping bag to releasably close the shopping bag and provide a comfortable unit handle for the bag.

Still a further object of the present invention is to provide a device of the above nature characterized by its convenience, simplicity, low cost and ease of use and application.

The above and other objects of the present invention will become apparent from the following description taken in conjunction with the accompanying drawings which illustrate preferred embodiments thereof.

A device in accordance with the present invention includes an outer longitudinal tubular preferably cylindrical grip member having an upper longitudinal slot extending for the length of the grip member and being formed of a soft resiliently flexible material and a relatively stiff longitudinal core member nesting in the grip member and extending for the length of the slot and having a longitudinal top face registering with the slot and a bottom face mating and engaging the inside bottom face of the grip member.

In one form of the device, the core member top face is transversely arcuately concave and is spaced below the bottom of the slot or is closely proximate the bottom of the slot or the upper part of the core member has formed therein a longitudinal wedge shaped groove with downwardly converging side faces delineating the core member top face. The grip member is advantageously formed of a foamed or expanded elastomeric material; for example, sponge rubber, natural or synthetic, and the core member may be formed of a relatively stiff synthetic organic polymeric material, wood or other suitable stiff material. The grip member may be enclosed in a sheath form of fabric or other plastic webs and traverses the grip slot to the core member top surface. The sheath may be in the form of a closed envelope.

The improved device is easy to apply to the longitudinal sections of the opposite flexible handles of a receptacle, the handle longitudinal sections downwardly and longitudinally traversing the grip member slot and being supported by the core member top surface. The device releasably locks the handle members together and provides a comfortable gripping surface.

DESCRIPTION OF THE PREFERRED EMBODIMENTS

Figure 1:
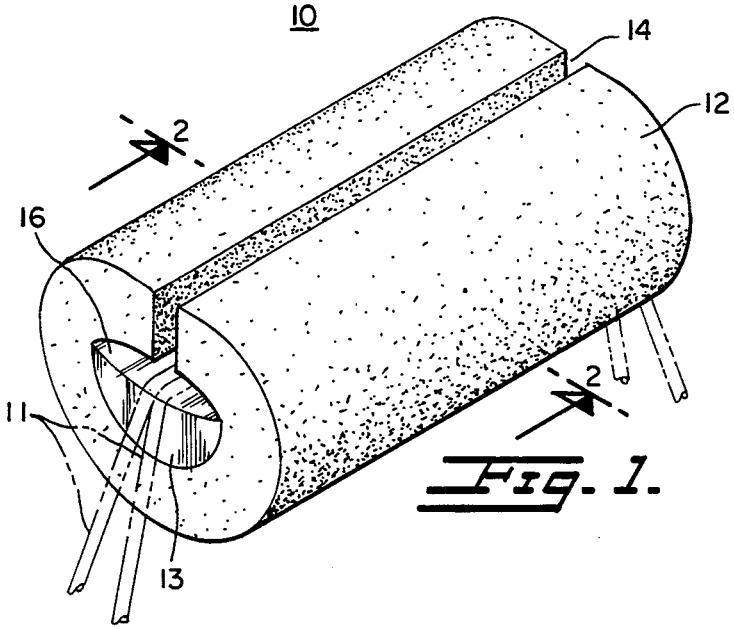
FIG. 1 is a perspective end view of a preferred embodiment of the present invention shown engaging the opposite handles of a receptacle.
Figure 2:
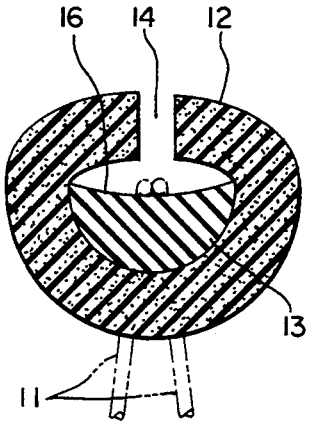
FIG. 2 is a sectional view taken along line 2—2 of FIG. 1.

Referring to the drawings, particularly FIGS. 1 and 2 thereof which illustrate a preferred embodiment of the present invention, the reference numeral 10 generally designates the improved handle grip device shown applied to the flexible string or plastic handles 11 of a receptacle such as a shopping bag or the like. The device 10 includes an outer cylindrical open ended tubular grip member 12 and a core member 13.

The grip member 12 is formed of a soft resiliently compressible material; for example, a sponge or expanded natural or synthetic rubber or other soft elastomeric material the faces of which are smooth skinned. Formed in the top of the wall of the grip member 12 is a slot 14 which extends for the full length of the grip member and is delineated by opposite vertical faces. While grip member 12 is shown of arcuate transverse cross-section with its top wall of lesser curvature than the bottom wall, it may be otherwise shaped and the grip member wall is of a suitable thickness; for example about ½ inch, while the horizontal outside width is about 1 ½ inch and the inside diameter is about 1 inch.

The core member 13 is formed of a suitable rigid material such as a synthetic organic polymeric material, wood or the like and is located in and extends for the length of grip member 12 and has a bottom face of arcuate transverse cross-section and mating on and engaging the lower inside face of grip member 12. Core member 13 has formed in its top surface a shallow concave groove 16 which extends longitudinally for the length of core member 13 and is disposed below the bottom of slot 14.

In application and use the opposite flexible handles 11 of the receptacle are brought together and inserted through the grip member slot and brought to rest on the underlying face of groove 16. The handles 11 are thereby shaped to extend parallel and longitudinally and firmly so held side-by-side and the rigid core member and the grip member 12 may be comfortably grasped and held. The device may be easily retracted from the handles 11 and applied to another pair of handles.

Figure 3:
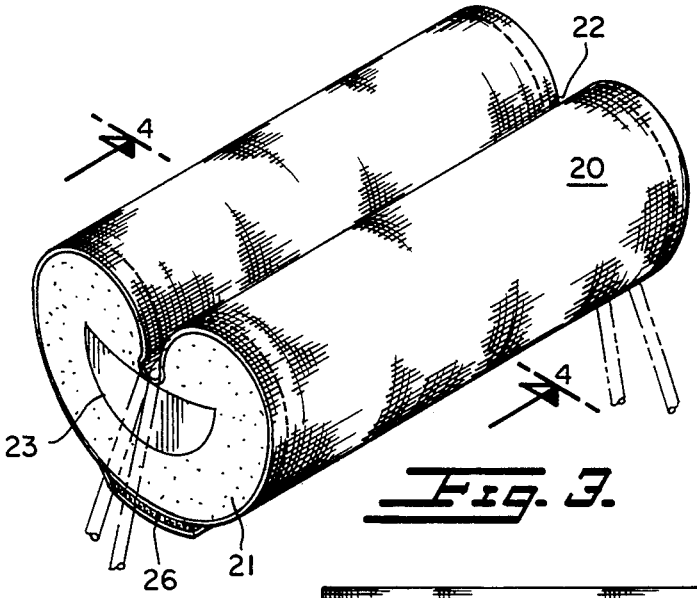
FIG. 3 is a perspective view of another embodiment of the present invention.
Figure 4:
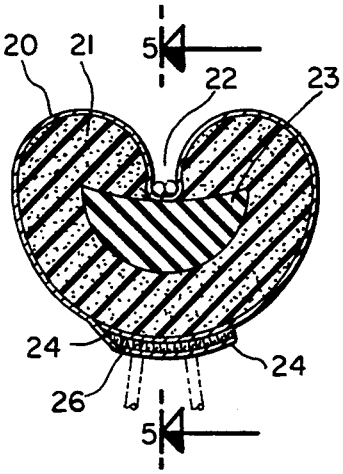
FIG. 4 is a sectional view taken along line 4—4 in FIG. 3.
Figure 5:
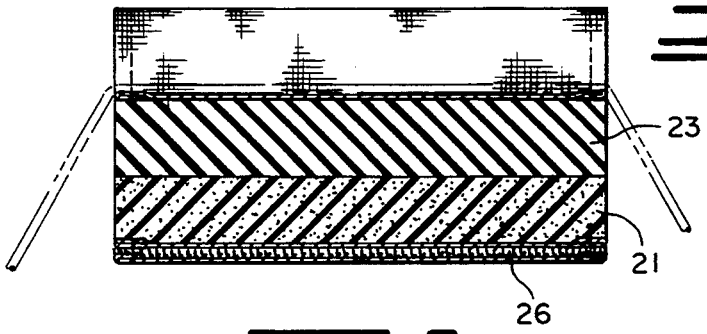
FIG. 5 is a sectional view taken along line 5—5 in FIG. 4.

The embodiment of the invention shown in FIGS. 3 to 5 differs from that first described primarily in the provision of a flexible sheath 20 covering the outer peripheral surface of the grip member 21. Grip member 21 is of a configuration similar to grip member 13 and formed of a resiliently compressible material and has a longitudinal slot 22 extending for the length of the grip member, the upper corner edges of slot 22 being curved to provide a downwardly converging throat. A rigid core member 23 extends along the length of the inside of grip member 21 and has a longitudinal peripheral surface engaged by and mating the inside face of grip member 21, the upper face of core member 23 being upwardly concave and extending the length of core member 23.

The sheath 20 is formed of a woven or non-woven web fabric of natural or synthetic fibers and extends along and engages the faces of slot 22 and across the bottom of the slot and the outer peripheral surface of grip member 21. The lower end borders 24 of sheath 20 overlap at the bottom of grip member 21 and are mutually preferably secured by, for example, confronting strips of VELCRO 26 which are affixed to the confronting faces of the overlapping borders of the sheath forming web.

The use and application of the device 20 is similar to that of the device 10 earlier explained.

Figure 6:
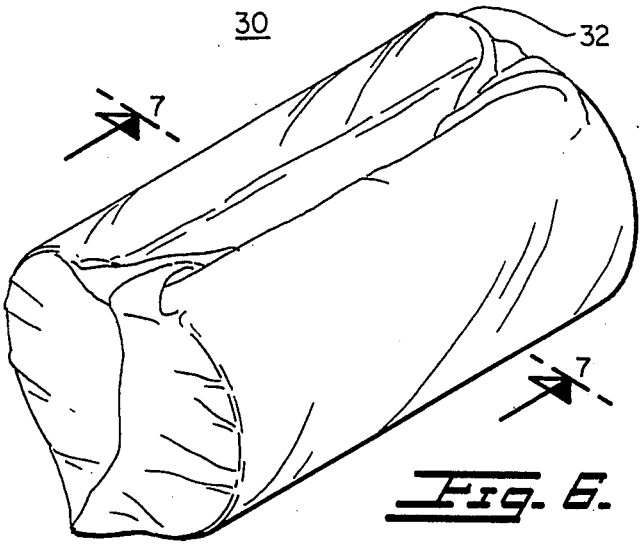
FIG. 6 is a perspective end view of still another embodiment of the present invention.
Figure 7:
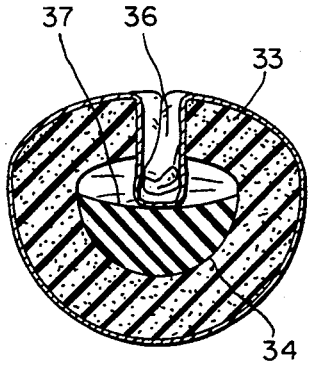
FIG. 7 is a sectional view taken along line 7—7 in FIG. 6.
Figure 8:
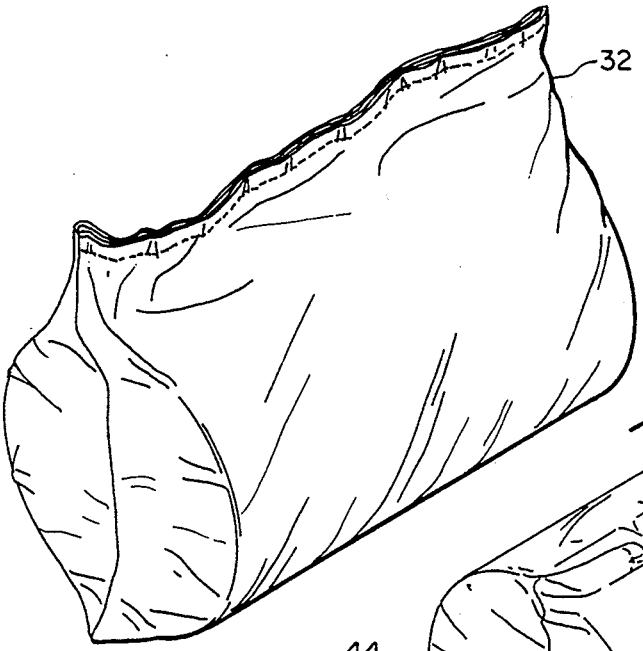
FIG. 8 is a perspective end view of the device shown in FIG. 6 in an intermediate stage of its construction.

Referring now to FIGS. 6 to 8 of the drawings, the modified device 30 illustrated therein differs from that first described in that the assembled grip and core members are enclosed in an envelope 32. Specifically, the grip member 33 and core member 34 are similar in construction, shape and relationship to that of grip member 12 and core member 13 and formed of similar materials, the grip member being provided with a longitudinal slot 36 and the core member having an upwardly concave face 37.

The envelope 32 is formed of a highly flexible material and is initially open at its top. The assembled grip member 33 and core member 34 are inserted into the open envelope 32 which is then heat sealed to a closed condition along the upper confronting borders of the envelope, the slot of the enclosed grip member confronting the sealed edge of the envelope. The sealed upper border of envelope 32 is then tucked through the underlying slot 36 into engagement with the core member top face 37 with the upper end borders of envelope 32 being tucked into end openings of slot 36.

The device 30 is employed in the same manner earlier described. The envelope 32 may be formed of fabric or other suitable flexible material instead of a thermoplastic polymeric material.

Figure 9:
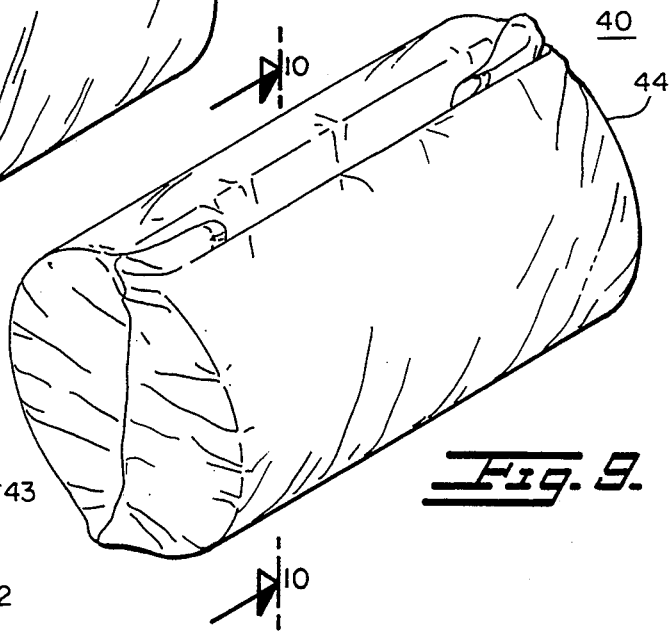
FIG. 9 is a view similar to FIG. 6 of a further object of the present invention.
Figure 10:
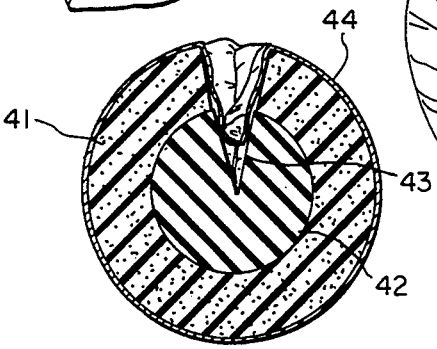
FIG. 10 is a sectional view taken along line 10—10 in FIG. 9.

The device 40 illustrated in FIGS. 9 and 10 of the drawings differs from that last described only in the shapes of the grip member 41 and core member 42. Specifically, the grip member 41 is of circular annular transverse cross-section and the core member 42 is of transverse circular cross-section and telescopes into the grip member 41 and is rotatable therein. A sector shaped groove 43 is formed along the length of core member 42 and is delineated by flat faces diverging from the central longitudinal axis of the grip member and the grip member 42 has a longitudinal slot formed along the length thereof delineated by opposite faces co-planar with respective faces of groove 43.

The assembled grip member 41 and core member 42 are inserted in an envelope 44 similar to envelope 32 which is then sealed along the borders of the envelope opening and the sealed envelope border is then inserted through the slot in the grip member 41 into the core member groove in the manner explained in connection with the last described embodiment.

While there have been described and illustrated preferred embodiments of the present invention, it is apparent that numerous alterations, omissions and additions may be made without departing from the spirit thereof.

I claim:

1. A handle grip device comprising a tubular grip member formed of a soft, resiliently compressible material and having a longitudinal slot formed along the length of an upper part thereof and a core member formed of a relatively stiff material nesting in said grip member along the lengths thereof and having a top surface space below and registering with said slot; a flexible web sheath extending above a peripheral surface of said grip member and through said slot to said core top surface.

2. The device of claim 1 wherein said core member has a longitudinal groove formed in said top surface, the face of which defines said top surface.

3. The device of claim 2 wherein said groove is upwardly concave.

4. The device of claim 2 wherein said groove is delineated by opposite faces converging downwardly to an apex.

5. The device of claim 1 wherein said core member is embedded in and embraced by said grip member and said slot extends to said core member top face.

6. The device of claim 5 wherein said slot is delineated by upwardly diverging oppositely curved convex faces.

7. The device of claim 1 wherein said web sheath includes end borders overlapping and materially fastened at the peripheral surface of said grip member.

8. Handle grip device comprising a tubular grip member formed of a soft resiliently compressible material and having a longitudinal slot formed along the length of an upper part thereof and ea core member formed of a relatively stiff material nesting in said grip member along the length thereof and having a top surface spaced below and registering with said slot; an envelope formed of a flexible material enclosing said grip member and said core member and extending through said slot to said core member top surface.

* * * * *